US005435241A

United States Patent [19]

Peters

[11] Patent Number: 5,435,241

[45] Date of Patent: Jul. 25, 1995

[54] DEVICE FOR SUSPENDING A SQUEEGEE IN A CYLINDRICAL SCREEN OF A ROTARY SCREEN PRINTING MACHINE

[75] Inventor: Henricus J. Peters, Cuijk, Netherlands

[73] Assignee: Stork Brabant, B.V., Boxmeer, Netherlands

[21] Appl. No.: 200,474

[22] Filed: Feb. 23, 1994

[30] Foreign Application Priority Data

Feb. 24, 1993 [NL] Netherlands ..... 9300338

[51] Int. Cl.[6] ..... B41F 15/44

[52] U.S. Cl. ..... 101/120; 101/114

[58] Field of Search ..... 101/114, 119, 120, 123, 101/124, 157, 169; 118/406, 413, 414; 248/202.1, 201

[56] References Cited

U.S. PATENT DOCUMENTS

| | | | |
|---|---|---|---|
| 3,942,438 | 3/1976 | Zimmer | 101/120 |
| 4,077,320 | 3/1978 | Weber et al. | 101/120 |
| 4,417,515 | 11/1983 | Mitter | 101/120 |
| 4,955,298 | 9/1990 | Zimmer et al. | 101/120 |
| 4,989,509 | 2/1991 | Zimmer | 101/120 |

FOREIGN PATENT DOCUMENTS 0463699 2/1992 European Pat. Off. .

*Primary Examiner*—Edgar S. Burr
*Assistant Examiner*—Stephen R. Funk
*Attorney, Agent, or Firm*—Deveau, Colton & Marquis

[57] ABSTRACT

A device for suspending a squeegee in a cylindrical screen of a rotary screen printing machine, in which the cylindrical screen is accommodated with both ends in drive and support units, and in which the squeegee extends in the lengthwise direction inside the cylindrical screen, comprises two squeegee supports, each disposed near one of the drive and support units, and each provided with an accommodation opening for the accommodation of one end of the squeegee. At the side facing the inside of the cylindrical screen, one of the squeegee supports is provided with a guide element for guiding an end of a squeegee into the accommodation opening when the squeegee is being mounted in the cylindrical screen.

4 Claims, 3 Drawing Sheets

DEVICE FOR SUSPENDING A SQUEEGEE IN A CYLINDRICAL SCREEN OF A ROTARY SCREEN PRINTING MACHINE

BACKGROUND OF THE INVENTION

The invention relates to a device for suspending a squeegee in a cylindrical screen of a rotary screen printing machine, in which the ends of the cylindrical screen are accommodated in drive and support units, and the squeegee extends in a longitudinal direction inside the cylindrical screen, which device comprises two squeegee supports, each disposed near one of the drive and support units, and each provided with an accommodation opening for the accommodation of one end of the squeegee.

Such a device is known in practice.

In rotary screen printing machines color paste is supplied by means of a squeegee to a cylindrical screen. The squeegee consists of a distribution system for distributing the color paste over the width of the squeegee and a squeegee blade which serves to force color paste through the screen.

In the case of the known device, when the squeegee is being mounted in a screen suspended in the drive and support unit, the squeegee is slid into the cylindrical screen from one side, following which the ends of the squeegee are mounted in the accommodation openings of the two squeegee supports disposed near the ends of the cylindrical screen.

The known device for suspending a squeegee has the disadvantage that the squeegee has to be mounted by two people, one on each side of the cylindrical screen. The first person slides the squeegee, which can be 3 to 3.5 meters long, into the cylindrical screen from one side. When the squeegee has been slid fully into the cylindrical screen, the second person, at the other side of the cylindrical screen, picks up the end of the squeegee slid through the screen and fixes it in the squeegee support situated at the side in question. The first person then fixes the other end of the squeegee in the appropriate squeegee support. During the mounting of the squeegee the two people often have to assume an awkward position and lift quite a heavy weight. In addition, there is the danger that when the squeegee is being mounted in the squeegee supports, the squeegee could fall and damage the screen.

SUMMARY OF THE INVENTION

The object of the invention is to provide a device for suspending a squeegee in a cylindrical screen of a rotary screen printing machine, in which the squeegee can be mounted in the cylindrical screen in a simple way by one person.

This object is achieved according to the invention by a device of the type mentioned in the preamble, which is characterized in that at the side facing the inside of the cylindrical screen one of the squeegee supports is provided with a guide element for guiding one end of a squeegee into the accommodation opening when the squeegee is being mounted in the cylindrical screen.

In the case of such a device the squeegee can be slid into the cylindrical screen by one person, in the course of which the slid-in end of the squeegee glides over the inside of the cylindrical screen, and the guide element ensures that said end is guided from the inside of the cylindrical screen into the accommodation opening of the corresponding squeegee support. A second person is no longer needed for this.

BRIEF DESCRIPTION OF THE DRAWINGS

The invention will be explained in greater detail with reference to the description of a preferred embodiment of the device according to the invention shown in the appended drawing, in which.

DETAILED DESCRIPTION OF A PREFERRED EMBODIMENT

Figure 1:
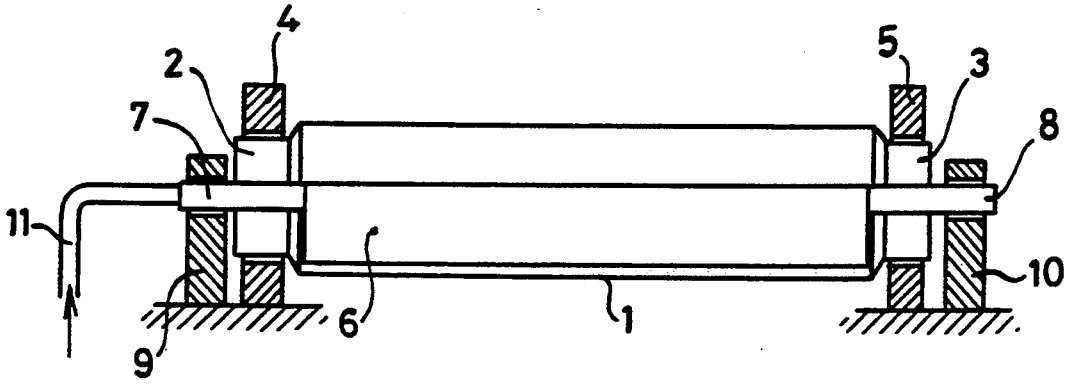
FIG. 1 shows very diagrammatically a cylindrical screen of a rotary screen printing machine which is supported at both ends by drive and support units.

FIG. 1 shows very diagrammatically a cylindrical screen 1 of a rotary screen printing machine, which screen is accommodated with both ends 2 and 3 in drive and support units 4 and 5 respectively. A squeegee 6, the ends 7 and 8 of which are accommodated in squeegee supports 9 and 10 respectively, extends in the lengthwise direction inside the cylindrical screen. A supply line 11 for supplying color paste is connected to the end 7 of the squeegee. The squeegee generally consists of a distribution system for distributing the color paste over the length of the squeegee, and thus over the width of the cylindrical screen, and a squeegee blade which serves to force the color paste through the screen. The squeegee can be of different designs, which are known per se and will not be discussed in any further detail here.

Figure 2:
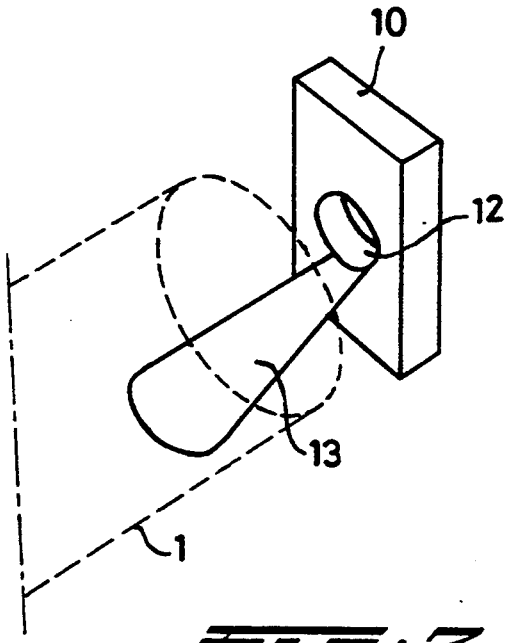
FIGS. 2 and 3 show very diagrammatically a squeegee support with guide element of a device according to the invention, in perspective and in front view respectively.
Figure 3:
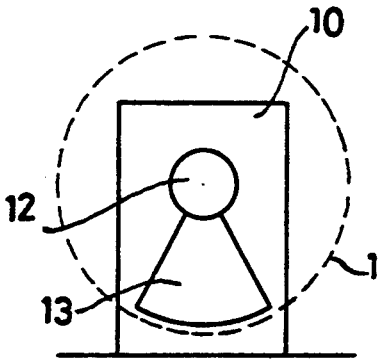

FIGS. 2 and 3 show very diagrammatically the squeegee support 10 with an accommodation opening 12 for accommodating one end 8 of the squeegee 6. The cylindrical screen 1 is shown diagrammatically by broken lines. At the side facing the inside of the cylindrical screen 1, the squeegee support 10 according to the invention is provided with a guide element 13 for guiding the end 8 of the squeegee 6 into the accommodation opening 12 when the squeegee 6 is being mounted in the cylindrical screen 1.

In the embodiment shown here, the guide element consists of a channel-shaped spoon which in the initial position, in which no squeegee end is situated in the accommodation opening 12 of the squeegee support 10, extends from the inside surface of the cylindrical screen 1 to the accommodation opening 12.

The use of the guide element 13 makes it possible for the squeegee 6 to be mounted in the cylindrical screen 1 by one person. This person slides the squeegee 6 at the end 2 into the cylindrical screen, in the course of which the end 8 of the squeegee 6 glides over the inside of the cylindrical screen 1. At a given moment the end 8 of the squeegee 6 will reach the guide element 13, following which on further sliding in of the squeegee 6, the guide element 13 guides the end 8 of the squeegee 6 into the accommodation opening 12 of the squeegee support 10. When the end 8 of the squeegee 6 is situated in the accommodation opening 12 of the squeegee support 10, the same person can mount the end 7 of the squeegee 6 in the squeegee support 9. The squeegee 6 can thus be mounted in the cylindrical screen by one person. This also minimizes the risk of the squeegee 6 falling on the cylindrical screen 1 in the course of mounting, and thereby damaging the screen.

Figure 4:
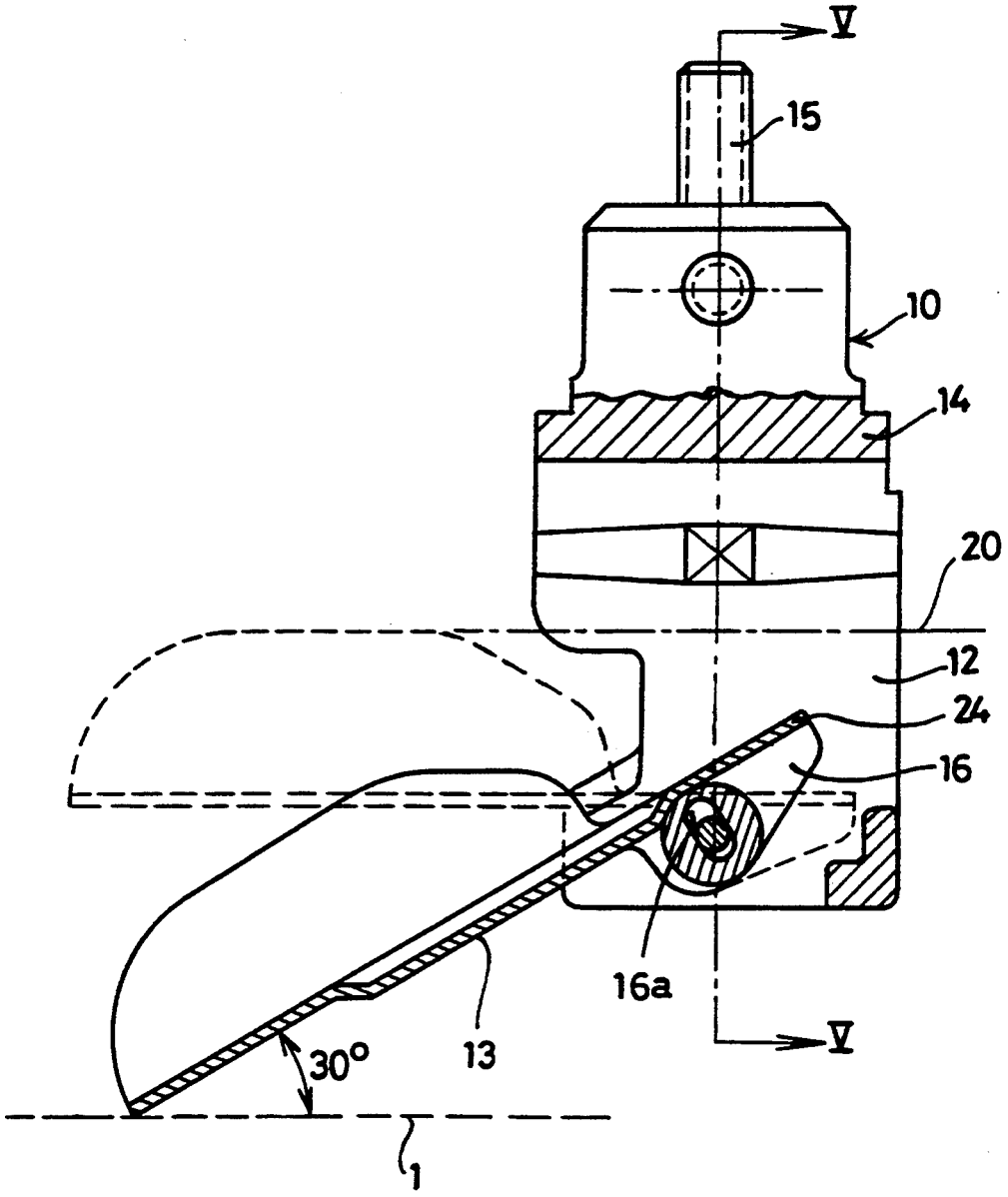
FIG. 4 shows a practical embodiment of a squeegee support with guide element in longitudinal section.
Figure 5:
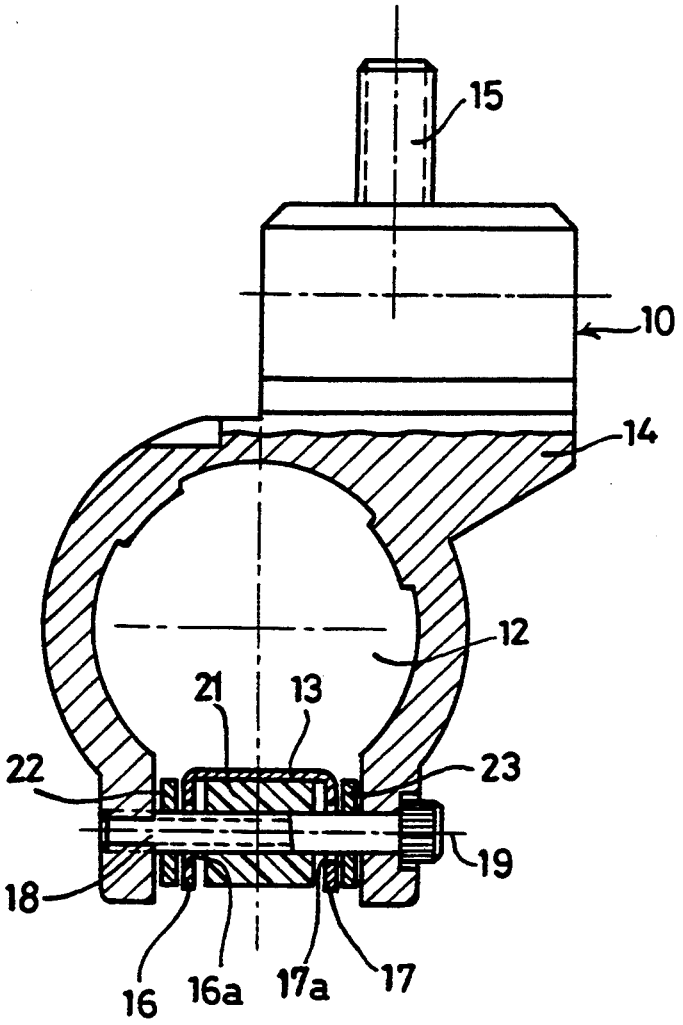
FIG. 5 shows the squeegee support of FIG. 4, in a section along the line V—V.

FIGS. 4 and 5 show a practical embodiment of the squeegee support 10 with guide element 13. The various parts are indicated by the same reference numbers as those in FIGS. 1 to 3. The squeegee support 10 comprises a squeegee support element 14 in which the accommodation opening 12 is disposed, and which can be fixed to the frame of the rotary screen printing machine by means of a stud bolt 15. The guide element in the form of a channel-shaped spoon 13 is hingedly connected to the squeegee support element 14. For this purpose, the channel-shaped spoon 13 is provided with two flanges 16 and 17 which extend parallel to the longitudinal center face of the channel-shaped spoon and are provided with slotted holes 16*a*, 17*a*, through which a bolt 18 projects, which bolt is screwed into the squeegee support element at the underside of the accommodation opening, and the axis 19 of which intersects the axis 20 of the accommodation opening 12 at right angles.

A ring 21, made of silicone rubber or another flexible material, is disposed between the two flanges 16 and 17. The channel-shaped spoon 13 rests on the ring 21. The hardness of the material of the ring 21 can be adapted to the weight of the squeegee which is being supported by the squeegee supports.

Two locking devices 22 and 23 are disposed all the way around the bolt 18 between the flanges 16 and 17 of the channel-shaped spoon and the squeegee support element 14.

The channel-shaped spoon 13 has an extension piece 24 extending past the axis of rotation formed by the axis 19 of the bolt 18. In the initial position of a channel-shaped spoon 13 shown in FIG. 4, said extension piece 24 extends until it is inside the accommodation opening 12.

During the insertion of the end 8 of the squeegee 6 into the accommodation opening 12, this end will be guided from the bottom of the cylindrical screen 1 (indicated by broken line in FIG. 4) through the channel-shaped spoon 13 to the accommodation opening 12. In this position (indicated earlier as initial position) the channel-shaped spoon 13 forms an angle of approximately 30 degrees with the bottom of the cylindrical screen 1. When the end 8 of the squeegee reaches the axis of rotation 19 of the channel-shaped spoon 13, on insertion of the end 8 of the squeegee further into the accommodation opening 12, the extension piece 24 of the channel-shaped spoon 13 will be pressed downwards by the end 8 of the squeegee, in which case the channel-shaped spoon pivots about the bolt 18. The channel-shaped spoon 13 will consequently rotate out of the position shown by solid lines in FIG. 4 (initial position) to the position shown by broken lines. The ring 21 is slightly deformed in this case, in such a way that the end 8 of the squeegee is accommodated without play in the accommodation opening 12 of the squeegee support 10.

This means that when the squeegee is in its working position and the cylindrical screen is rotating, the channel-shaped spoon 13 does not drag over the inside of the cylindrical screen 1, thereby avoiding possible damage to the screen.

When the squeegee 6 is removed again from the squeegee support 10 at a later stage, the channel-shaped spoon 13 will be rotated again to the initial position shown in FIG. 4.

In the example of an embodiment shown, the guide element is in the form of a channel-shaped spoon. Of course, other types of guide elements are also possible, and are within the scope of the invention.

The design of the squeegee suspension according to the invention can be used not only in rotary screen printing machines with one or more cylindrical screens, but also in coating machines in which a web of material is being coated uniformly with a certain substance which is being applied by means of a squeegee.

There is no cylindrical screen in such a coating machine. The guide element then extends in the initial position from the surface of the web of material and/or a supporting bar lying below it to the accommodation opening in the squeegee support.

What is claimed is:

1. A device for suspending a squeegee in a cylindrical screen of a rotary screen printing machine, in which the ends of the cylindrical screen are accommodated in drive and support units, and the squeegee extends in a longitudinal direction inside the cylindrical screen, which device comprises two squeegee supports, each disposed near one of the drive and support units, and each provided with an accommodation opening for the accommodation of one end of the squeegee, wherein one of the squeegee supports is provided with a guide element for guiding one end of the squeegee from an unmounted position in which the one end of the squeegee is not aligned with the accommodation opening towards and into the accommodation opening during mounting of the squeegee in the cylindrical screen.

2. The device according of claim 1, wherein the guide element consists of a channel-shaped spoon which is an initial position, in which no squeegee and is situated in the accommodation opening of the squeegee support, extends from an inside surface of the cylindrical screen to the accommodation opening.

3. The device according of claim 2 further comprising means for allowing said channel-shaped spoon to rotate, wherein the channel-shaped spoon is rotatable about an axis of rotation which is situated at an underside of the accommodation opening in the squeegee support and is perpendicular to the axis of the accommodation opening.

4. The device according of claim 3, wherein the channel-shaped spoon has an extension piece extending past the axis of rotation of the spoon, and in the initial position of the channel-shaped spoon extending until it is inside the accommodation opening.

* * * * *